United States Patent [19]

Lagos

[11] 4,451,757

[45] May 29, 1984

[54] FLUORESCENT LAMP HAVING IMPROVED MAINTENANCE

[75] Inventor: Costas C. Lagos, Danvers, Mass.

[73] Assignee: GTE Products Corporation, Stamford, Conn.

[21] Appl. No.: 342,531

[22] Filed: Jan. 25, 1982

[51] Int. Cl.[3] ..... H01J 1/70; B05D 5/06

[52] U.S. Cl. ..... 313/489; 427/67

[58] Field of Search ..... 313/489; 427/67

[56] References Cited

U.S. PATENT DOCUMENTS 2,905,572 9/1959 Jones ..... 427/73 X
3,503,780 3/1970 Kamiya ..... 427/67 X
3,887,725 6/1975 Halstead, Jr. et al. ..... 427/67
4,121,132 10/1978 Repsher ..... 313/486

FOREIGN PATENT DOCUMENTS 45-7438 of 1970 Japan ..... 427/67

*Primary Examiner*—Palmer C. Demeo
*Assistant Examiner*—Sandra L. O'Shea
*Attorney, Agent, or Firm*—William H. McNeill

[57] ABSTRACT

Lumen maintenance of fluorescent lamps is improved by dispersing throughout the phosphor a small quantity, less than 0.2% by weight of the phosphor, of a metallic borate. The improvement is realized in lamps with or without an internal conductive coating.

4 Claims, 3 Drawing Figures

FLUORESCENT LAMP HAVING IMPROVED MAINTENANCE

TECHNICAL FIELD

This invention relates to phosphor containing arc discharge lamps. More particularly it relates to fluorescent arc discharge lamps having improved maintenance.

BACKGROUND ART

Fluorescent lamps are available in many sizes and shapes with outputs of various colors. All include a transparent glass envelope of tubular configuration having a layer of phosphor on the interior thereof and electrodes at the ends. The envelope is hermeticlly sealed and contains a small quantity of mercury together with an inert gas. These lamps are available in two basic varieties: a standard lamp wherein the phosphor or luminescent material is applied to the interior surface of the envelope and the fill gas is argon, and energy saving types which include a transparent conductive coating on the interior of the envelope over which the phosphor is applied. These latter lamps usually include a heavier molecular weight fill gas such as krypton.

All types of fluorescent lamps experience a gradual decrease in light output (usually measured in lumens) as they age. The degree to which light output is maintained relative to time of use is termed maintenance or lumen maintenance, and is expressed as a percentage.

While the extract reason for the lumen decrease is not known with absolute certainty, it is believed that the formation of mercury compounds, particularly on the surface of the phosphor, is one of the primary factors.

It is postulated that these mercury compounds form an ultraviolet radiation absorbing film which prevents the phosphor from receiving sufficient exciting radiation from the mercury discharge to achieve maximum light output.

Various uses of alumina within such lamps have been proposed to alleviate this condition. For example, U.S. Pat. Nos. 4,079,288 and 4,058,639, as well as others, discuss employing a layer of alumina on the interior of the envelope wall and applying phosphor thereover.

U.S. Pat. No. 3,886,396 teaches the application of a thin porous overcoat of alumina on the phosphor layer, and U.S. Ser. No. 228,865 teaches a heavy overcoat of alumina. While all of these techniques provide some benefit, it is believed that simpler and more economical procedures and materials for accomplishing the result would be an advance in the art.

DISCLOSURE OF THE INVENTION

It is, therefore, an object of the invention to obviate the disadvantages of the prior art.

It is another object of the invention to enhance the lumen maintenance of fluorescent lamps.

These objects are accomplished, in one aspect of the invention, by the provision, within a fluorescent lamp, of a luminescent material of a given weight which includes a substantially homogeneous dispersion of a metallic borate.

The borate compounds have been found to provide a significant increase in lumen maintenance in both the standard and energy saving versions of fluorescent lamps.

BEST MODE FOR CARRYING OUT THE INVENTION

For a better understanding of the present invention, together with other and further objects, advantages and capabilities thereof, reference is made to the following disclosure and appended claims taken in conjunction with the above described drawings.

Figure 1:
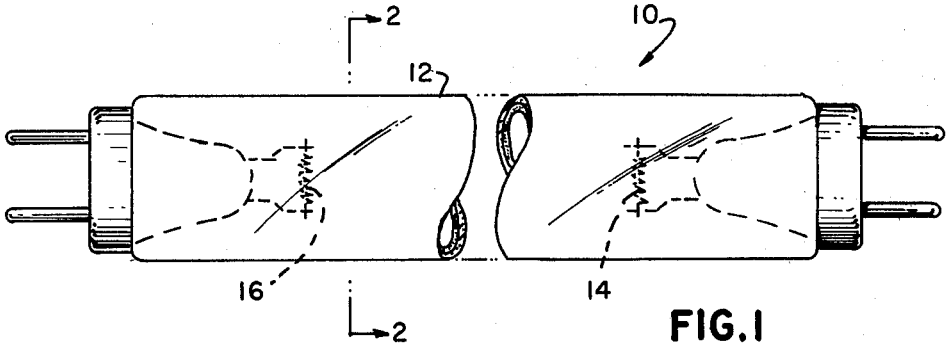
FIG. 1 is a diagrammatic, elevational view of a fluorescent lamp employing the invention.

Referring now to the drawings with greater particularity, there is shown in FIG. 1 a fluorescent lamp 10 comprised of a tubular glass envelope 12 having electrodes 14 and 16 sealed therein. Envelope 12 is hermetically sealed and contains a small amount of mercury and a fill gas.

Figure 2:
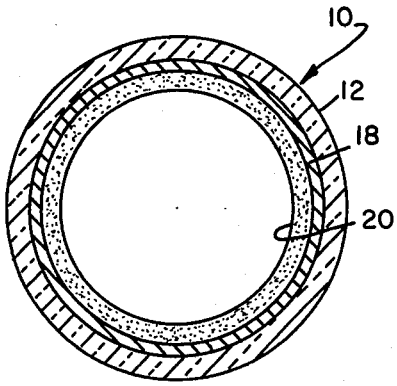
FIG. 2 is a sectional view taken along the line 2—2 of FIG. 1.

The sectional view of FIG. 2 illustrates an energy saving lamp wherein a transparent conductive coating 18, such as tin oxide, is applied to the inner surface of envelope 12. A layer of phosphor 20, such as a calcium halophosphate, is applied over the conductive layer 18. In such lamps a heavy molecular weight gas, such as krypton, is employed.

Figure 3:
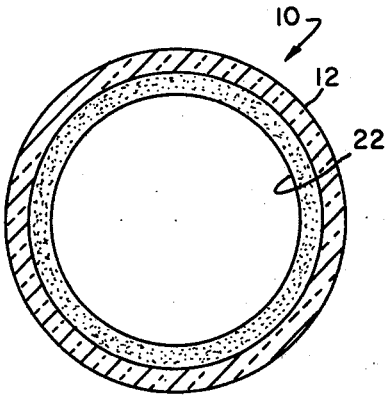
FIG. 3 is a sectional view similar to that of FIG. 2 and illustrating another embodiment of the invention.

FIG. 3 illustrates a conventional lamp wherein a phosphor layer 22 is applied directly to the inner surface of envelope 12.

It has been found that the addition of small amounts of certain borates to the phosphor layer improves the lumen maintenance of lamps containing the tin oxide film 18. These borates are relatively inexpensive and their addition to the phosphor layer involves no appreciable extra handling nor any other problems to either the phosphor coating or the lamp manufacturing processes.

The following four foot fluorescent lamp tests utilizing the tin oxide coated energy lamp construction shows the effects of adding small amounts of sodium borate ($Na_2B_4O_7.10H_2O$) to the phosphor coating suspensions that were used to flush coat over the tin oxide films.

| | TEST NO. 1 | | | | |
|---|---|---|---|---|---|
| | Lumens At | | | Lumens At | |
| | 0 Hrs. | 100 Hrs. | % M | 500 Hrs. | % M |
| Control ($SnO_2$ film with no borate add'n.) | 2850 | 2670 | 93.7 | 2496 | 87.6 |
| .02% $Na_2B_4O_7.10H_2O$ (by wt. of phosphor) | 2850° | $2696^{+26}$ | 94.6 | $2519^{+23}$ | 88.4 |
| .05% $Na_2B_4O_7.10H_2O$ (by wt. of phosphor) | $2860^{+10}$ | $2717^{+47}$ | 95.0 | $2540^{+44}$ | 88.8 |

| | TEST NO. 2 | | | | |
|---|---|---|---|---|---|
| | Lumens At | | | Lumens At | |
| | 0 Hrs. | 100 Hrs. | % M | 500 Hrs. | % M |
| Control ($SnO_2$ film with no borate add'n.) | 2858 | 2681 | 93.8 | 2488 | 87.0 |
| .02% $Na_2B_4O_7.10H_2O$ (by wt. of phosphor) | $2861^{+3}$ | $2699^{+18}$ | 94.3 | $2615^{+28}$ | 87.9 |
| .05% $Na_2B_4O_7.10H_2O$ (by wt. of phosphor) | $2862^{+4}$ | $2715^{+34}$ | 94.9 | $2512^{+24}$ | 87.8 |
| .12% $Na_2B_4O_7.10H_2O$ (by wt. of phosphor) | $2817^{-41}$ | $2686^{+5}$ | 95.3 | $2504^{+16}$ | 88.9 |

In Test No. 1, lumen gains and maintenance improvements are obtained for 0.02% and 0.05% $Na_2B_4O_7.10H_2O$ at both 100 hours and 500 hours lamp life. Concentrations of $Na_2B_4O_7.10H_2O$ above 0.05% by weight of phosphor (0.12% in Test No. 2) still show a maintenance gain at both 100 and 500 hours life but slightly lower lumen output initially. As the lamps are operated, however, the improved maintenance effect compensates for the initial lower lumens, and a lumen gain over the control is observed at 500 hours life.

The use of sodium borate ($Na_2B_4O_7.10H_2O$) to give improved lumen maintenance is unusual in that in many technical papers pertaining to both tin oxide films and to fluorescent lamps, the presence of sodium in any form is always deemed extremely detrimental to either the film or to the fluorescent lamp performances, and painstaking efforts are taken to exclude it from both areas. Here, however, it has been shown that the presence of sodium is not harmful but actually helpful when it is utilized as $Na_2B_4O_7.10H_2O$.

In standard construction of fluorescent lamps (containing no tin oxide film), it has been found that the addition of barium borate ($BaB_2O_4.H_2O$) to the phosphor layer also results in improved lumen maintenance as shown in the following lamp test:

| | TEST NO. 3 | | | | | |
|---|---|---|---|---|---|---|
| | Lumens At | | | Lumens At | | |
| | 0 Hrs. | 100 Hrs. | % M | 1000 Hrs. | 3000 Hr. | % M |
| Control (No $BaB_2O_4.H_2O$ | 3185 | 3077 | 96.6 | 2954 | 2833 | 88.9 |
| .03% $BaB_2O_4.H_2O$ (By wt. of phosphor) | $3199^{+14}$ | $3104^{+24}$ | 96.9 | $2988^{+34}$ | $2862^{+29}$ | 89.5 |
| .07% $BaB_2O_4.H_2O$ (By wt. of phosphor) | $3205^{+20}$ | $3116^{+39}$ | 97.2 | $2992^{+38}$ | $2883^{+50}$ | 89.9 |

The barium borate, as in the case of the sodium borate, may be either added to the phosphor prior to its being placed in suspension or added to the phosphor coating suspension. In either case, care should be taken that the borate addition is well mixed with the phosphor to form a substantially homogeneous dispersion.

The borate powders should be finer than 200 mesh in particle size, and lamps utilizing their addition require no special treatments. Normal lamp processing steps are used in binder bakeout, sealing and evacuating.

Other borates such as zinc borate ($Zn_3B_4O_9.5H_2O$) and calcium borate ($CaB_4O_7$) have also been employed as phosphor additives (Test No. 4 below), but barium borate appears to give the best results thus far. These other borates show improvements in lamp maintenance also, but with somewhat lower initial lumens. Test No. 4 was made utilizing standard lamp construction with no tin oxide film on the glass.

| | TEST NO. 4 | | | |
|---|---|---|---|---|
| | Lumens At | | | |
| | 0 Hrs. | 100 Hrs. | 1000 Hrs. | % M |
| Control (no borates) | 3132 | 3050 | 2864 | 91.4% |
| .02% $Zn_3B_4O_9.5H_2O$ | $3080^{-52}$ | $2989^{-61}$ | $2833^{-31}$ | 92.0 |
| .05% $Zn_3B_4O_9.5H_2O$ | $3053^{-79}$ | $2973^{-77}$ | $2834^{-30}$ | 92.8 |
| .01% $CaB_4O_7$ | $3111^{-21}$ | $3024^{-26}$ | $2865^{+1}$ | 92.1 |
| .027% $CaB_4O_7$ | $3118^{-14}$ | $3036^{-14}$ | $2887^{+23}$ | 92.6 |

The mentioning of only sodium borate, barium borate, zinc borate, and calcium borate as additives to the phosphor layer does not necessarily imply that other borate compounds will not give the same lumen maintenance improvements in fluorescent lamps, nor should it be assumed that all borate compounds used as additives would lead to lumen maintenance improvements.

The mechanism as to why these borates lead to lamp improvements has also not yet been determined. One could postulate that the borate may form a protective film over the phosphor, but this appears to be improbable due to:

1. the extremely small quantity of the additive used, and
2. the melting points of these borate compounds are considerably higher than any temperature the lamp sees during processing and/or operation.

This, however, does not preclude the reaction of these borates with the phosphor at lower temperatures than their melting points.

What has been determined, however, is that the addition of various borates to phosphor layers in fluorescent lamps does result in improvements to both lumens and maintenance.

While there have been shown and described what are at present considered the preferred embodiments of the invention, it will be apparent to those skilled in the art that various changes and moditications can be made herein without departing from the scope of the invention as defined by the appended claims.

I claim:

1. A fluorescent lamp comprised of a tubular glass envelope having electrodes sealed in the ends thereof and having in its interior a luminescent material of a given weight, said luminescent material including a substantially homogeneous dispersion of a metallic borate in an amount effective to increase the lumen maintenance of said lamp, said borate having the general formula $$MB_xO_yZH_2O$$

where

M=Na; Ba; Zn; or Ca; and when M=Na, then x=4, y=7, and Z=10;

when M=Ba, then x=2, y=4, and Z=1;

when M=Zn, then x=4, y=9, and Z=5;

when M=Ca, then x=4, y=7, and Z=0; and wherein said borate comprises from about 0.02 to about 0.12% by weight of said luminescent material.

2. The lamp of claim 1 wherein said tubular glass envalope has a transparent conductive coating on the interior surface thereof; said luminescent material overlies said conductive coating and said borate comprises $Na_2B_4O_7.10H_2O$ in an amount of about 0.02 to 0.05% by weight of said luminescent material.

3. The lamp of claim 1 wherein said luminescent material is applied to the interior surface of said glass envelope and said borate comprises $BaB_2O_4.H_2O$ in an amount of about 0.03 to 0.07% by weight of said luminescent material.

4. A luminescent material including a substantially homogeneous dispersion of a metallic borate having the general formula $$MB_xO_yZH_2O$$

where

M=Na; Ba; Zn; or Ca; and when M=Na; then x=4, y=7, and Z=10;

when M=Ba; then x=2, y=4, and Z=1;

when M=Zn, then x=4, y=9, and Z=5;

when M=Ca, then x=4, y=7, and Z=0; and wherein said borate comprises from about 0.02 to about 0.12% by weight of said luminescent material.

* * * * *